United States Patent [19]

Katsuo

[11] Patent Number: 4,873,526

[45] Date of Patent: Oct. 10, 1989

[54] MOBILE STATION ANTENNA ATTITUDE CONTROL APPARATUS

[75] Inventor: Suzuki Katsuo, Tokyo, Japan

[73] Assignees: Aisin Seiki Kabushiki Kaisha, Aichi; Kabushiki Kaisha Shinsangyokaihatsu, Tokyo, both of Japan

[21] Appl. No.: 217,524

[22] Filed: Jul. 7, 1988

[30] Foreign Application Priority Data

Jul. 8, 1987 [JP] Japan ..... 62-170623

[51] Int. Cl.[4] ..... H01Q 3/00

[52] U.S. Cl. ..... 342/359; 343/713; 318/649

[58] Field of Search ..... 342/359; 343/713; 318/649

[56] References Cited

U.S. PATENT DOCUMENTS 4,035,805 7/1977 Mobley ..... 318/649

4,630,056 12/1986 Noguchi et al. ..... 342/359

4,735,843 2/1988 Suzuki et al. ..... 342/359

*Primary Examiner*—Theodore M. Blum

*Attorney, Agent, or Firm*—Sughrue, Mion, Zinn, Macpeak & Seas

[57] ABSTRACT

A mobile station antenna attitude control apparatus comprising an antenna, a drive mechanism, a receiving level detecting means, a first device information setting means, an attitude detecting means, a second drive information setting means, a drive information correcting means and a control means. With such structure, the antenna is driven and controlled with the first dirve information and the drive information which has been obtained by correcting the second drive information depending on change on time thereof. Thereby, the antenna is capable of accurately tracking the signal source even if an automobile moves quickly. Moreover, since such tracking is based on the feedback control, structure and control can be very much simplified.

4 Claims, 14 Drawing Sheets

MOBILE STATION ANTENNA ATTITUDE CONTROL APPARATUS

FIELD OF THE INVENTION

The present invention relates to a mobile station antenna attitude control and particularly to attitude control for receiving antenna which is capable of tracking the signal source.

BACKGROUND OF THE INVENTION

For example, a mobile station (hereinafter referred to as an automobile) such as automobile, ship and aircraft, etc. is sometimes provided with an antenna to make mobile communication, television broadcast reception, radio broadcast reception or communication for recognition of self-position (hereinafter referred to as mobile communication) with a fixed station or a satellite station. In such communications, a very low level signal is used and therefore a high gain and high directivity antenna is often employed in order to establish clear communication by eliminating noise interference. However, such a high directivity antenna provides extremely deteriorated quality of communication or, in the worst case, cease of communication, if its direction (main lobe direction: attitude of antenna) deviates even a little. Therefore, attitude control is a very important factor for such high directivity antenna to establish high quality communication.

An antenna attitude control apparatus which tracks the signal source with a high directivity antenna by the continuous lobing system has already been proposed. Such apparatus makes reality the attitude control of antenna by scanning the main lobe of antenna and detecting relative moving direction of signal source for the antenna from change of incoming signal (changes of phase and intensity).

For instance, an antenna attitude control apparatus of the step track system samples intensity (namely receiving level) of incoming signal in every step of change (for example, $\frac{1}{2}$ of half-value angle of antenna) in attitude of the antenna and decides the next attitude of antenna for the attitude control depending on change of intensity of the incoming signal.

However, if attitude of automobile changes suddenly, tracking for signal source by the continuous lobing system becomes difficult in some cases.

In more concrete, here considered is an example that the mobile communication is carried out by mounting an antenna on automobile and tracking the signal source in the step track system. The attitude of running automobile always changes (yawing, pitching, rolling) in accordance with road and running conditions and if such change of attitude gives change of several steps momentarily (within the period shorter than the ordinary attitude renewing period) for the antenna attitude, continuity of step tracking is lost and thereby the antenna misses the signal source.

The inventors of the present invention proposed, in order to eliminate such inconvenience, the mobile station antenna attitude control apparatus (Patent Application No. 60-066128) which forecasts the behavior of automobile using many sensors and thereby corrects antenna attitude. According to this prior art, for example, in case the apparatus of this prior art is applied to the mobile communication by the step track system explained above, if an automobile quickly changes its attitude enough to give attitude change of several steps to the antenna within a moment, since the correction for cancelling such change of attitude of automobile from the forecasted behavior thereof, continuity of step tracking is maintained and accurate tracking for signal source can be realized.

As explained above, this prior art ensures excellent trackability but also has a problem that structure and control method is a little complicated.

SUMMARY OF THE INVENTION

It is therefore an object of the present invention to provide a mobile station antenna attitude control apparatus which accurately tracks the signal source, even if an automobile makes quick change of attitude, through simplified structure and control.

In order to attain the aforementioned object, the present invention discloses a mobile station antenna attitude control apparatus which comprises an antenna driving mechanism to freely control attitude of antenna supported on an automobile, further comprising:

- a receiving level detecting means for detecting receiving signal level of antenna;
- a first driving information setting means for monitoring the receiving level and newly setting a first driving information for changing attitude of antenna in the direction of increasing such receiving level;
- an attitude detecting means for detecting attitude information of automobile;
- a second driving information setting means for newly setting a second driving information for correcting relative change of attitude of antenna by attitude change of automobile on the basis of the attitude information;
- a driving information correcting means for monitoring change on time of the second driving information and correcting the second driving information depending on such change of second driving information; and
- a control means for controlling the first driving information set by the first driving information setting means, the second driving information corrected by the driving information correcting means and the driving mechanism.

According to the present invention, driving of antenna is controlled based on the first driving information for driving the antenna to the attitude for obtaining higher receiving level and the drive information obtained by correcting, on the basis of change on time of the second drive information, the second drive information for correcting relative change of attitude of antenna due to attitude change of automobile. Namely, since the relative change of attitude of antenna can be converged more quickly than that in case the attitude control is carried out only using the second drive information, by weighting the second drive information with change on time thereof, the antenna is capable of accurately tracking the signal source even for quick movement of automobile by controlling attitude of antenna using such weighted second driving information and the first driving information.

In this case, the trackability similar to that in the attitude control of antenna based on the forecasted behavior of automobile can certainly be obtained and moreover structure and control can be very simplified since the control is based on the feedback control.

In the present invention, the second driving information is used to correct relative change of attitude of antenna due to attitude change of automobile. Therefore, "change on timing of the second driving information" means "change on timing of automobile attitude".

Other objects and characteristics of the present invention will become apparent from the description of a preferred embodiment thereof with reference to the accompanying drawings.

DETAILED DESCRIPTION OF THE INVENTION

Figure 1:
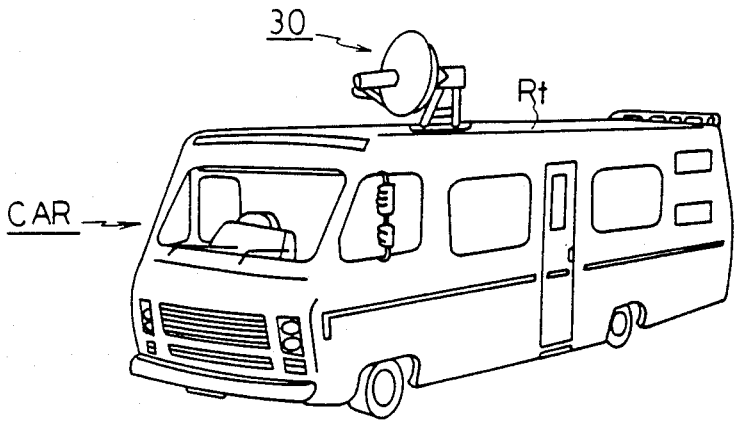
FIG. 1 is a perspective view indicating external appearance as an embodiment of the present invention.

FIG. 1 is an external appearance of an embodiment of the present invention. In FIG. 1, CAR is automobile and an antenna for receiving satellite broadcast programs (hereinafter referred to as antenna) 30 is provided on the roof thereof. In the case of this embodiment, a commercially available parabolic antenna for receiving satellite broadcast programs is used for the principal portion of the antenna 30.

Figure 3A:
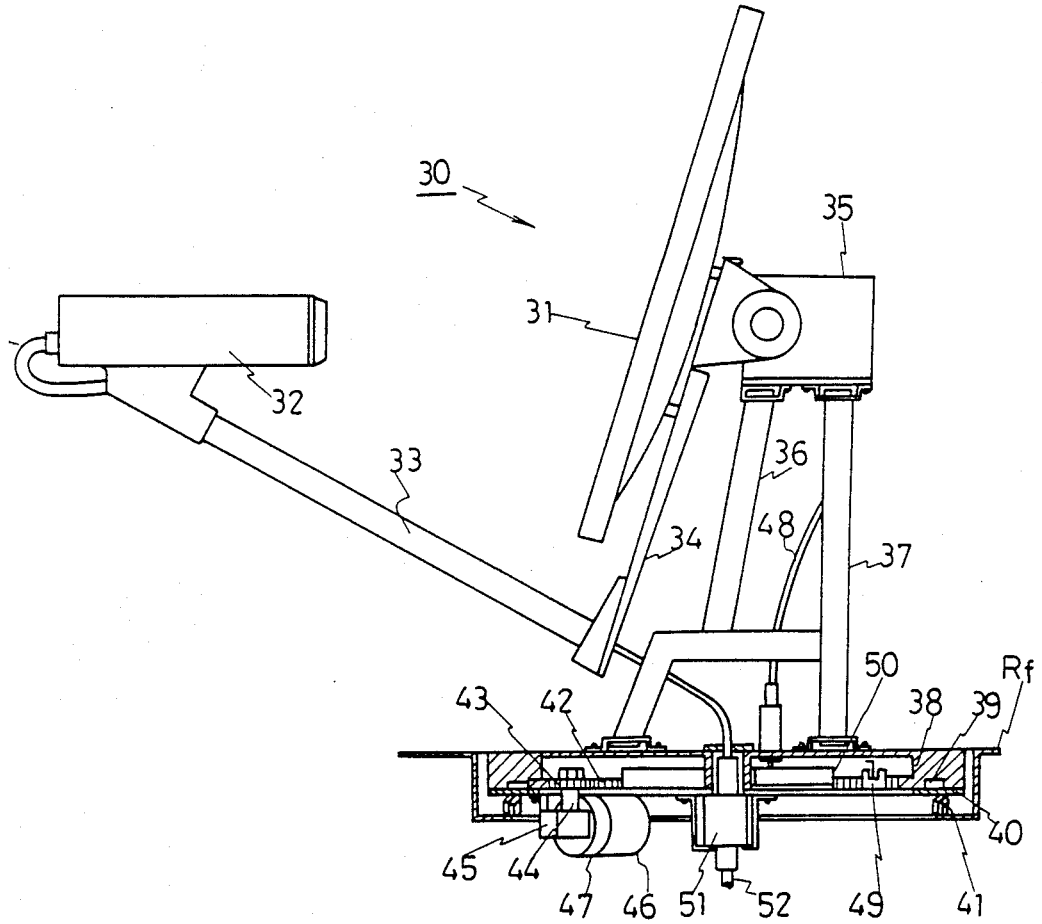
FIG. 3*a* and FIG. 3*b* are partial sectional views of structure of antenna 30 indicated in FIG. l.
Figure 3B:
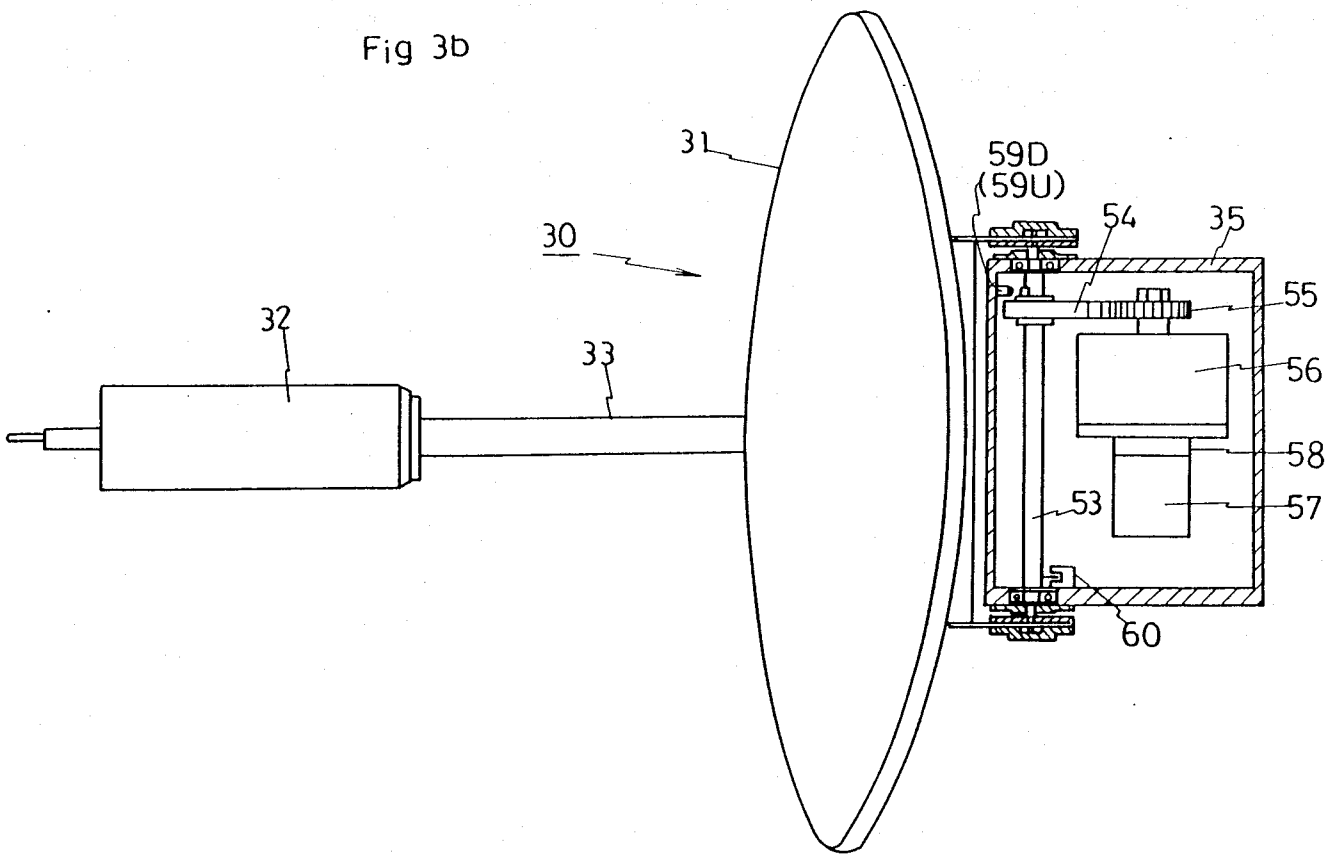

The antenna 30 is explained hereunder with reference to FIG. 3*a* and FIG. 3*b*.

In FIG. 3*a*, 31 is parabolic reflector and 32 is primary radiator integrated to a BS convertor. The antenna 30 forms the radiation lobe (main lobe: same in hereafter) of half, value angle 2° in the frequency used with this parabolic reflector 31 and the primary radiator 32.

The primary radiator 32 integrated to the BS convertor (hereinafter referred to as BS convertor) is fixed to the parabolic reflector 31 through support arms 33 and 34 and the parabolic reflector 31 is pivotally supported by a support box 35 through a support plate fixed to the rear side.

The support box 35 is fixed to a rotary base of antenna 30 by frames 36 and 37. The rotary base 38 is rotatably supported by a fixing base 40 through a bearing 39.

The fixing base 40 is fixed to a circular recessed part of roof Rf of automobile CAR and a weather strip 41 is loaded to the contact region of roof Rf and fixing base 38.

A ring-shaped internal tooth 42 is engraved on the rotary base 38 and a gear 43 is engaged with this internal gear 42. A shaft 44 fixing this gear 43 is engaged with a rotary shaft of azimuth drive motor 46 through a gear box 45.

The rotary shaft of azimuth drive motor 46 is coupled with a rotary encoder 47.

Since the azimuth drive motor 46 is fixed to the fixing base 40, when it is energized for normal rotation, it rotates the rotary base 38 clockwise observed from just above the figure (FIG. 3*b*) (clockwise rotation in the azimuth direction) and when it is energized for reverse rotation, it rotates the base 38 counterclockwise (counterclockwise rotation in the azimuth direction). Namely, energization for normal rotation of azimuth drive motor 46 causes the radiation lobe of antenna 30 to be directed to the right and energization for reverse rotation causes the radiation lobe of antenna 30 to be directed to the left.

The rotary encoder 47 outputs a pulse for every change of attitude for 0.5° in the azimuth direction of antenna 30.

49 is photo-interrupter for detecting home position in the azimuth direction (hereinafter referred to as Az sensor) and a light shielding filler provided to the lower side surface of rotary base 38 advances thereto at the home position.

A cable 48 connected to electrical element in the support box 35 of antenna 30 is connected to a cable (not illustrated) in the fixing side through a disk type slip ring unit 50.

An electrical cable connected to the output terminal of BS converter 32 is connected to the fixing side cable 52 through a cylindrical rotary joint 51.

FIG. 3*b* is a plan view observed from just above FIG. 3*a* and the interior of support box 35 is explained with reference to such figure.

The support plate fixed to the rear side of parabolic reflector 31 is fixed to both ends of rotary shaft 53 pivotally supported by the support box 35 through a bearing.

A sector gear 54 is fixed to the rotary shaft 53 and this sector gear 54 engages with a gear 55 fixed to the output shaft of gear box 56.

The input shaft of gear box 56 is coupled with the rotary shaft of elevation drive motor 57 through a rotary encoder 58.

Since the elevation drive motor 57 is fixed to the support box 35, when it is normally rotated, the parabolic reflector 31 and BS converter 32 rotate together upward (clockwise rotation in FIG. 3*a*: upward rotation in the elevation direction) and when it is reversely rotated, these rotate together downward (counterclockwise rotation in FIG. 3*a*: downward rotation in the elevation direction). Namely, the radiation lobe of antenna 30 directs upward by energization for normal rotation of elevation drive motor 57, while it directs downward by energization for reverse rotation.

The rotary encoder 58 outputs one pulse for every change of elevation of antenna 30 in the step of 0.5°.

Although overlapped in FIG. 3*b*, 59U in the deeper side is a limit switch for detecting the limit angle of incidence of antenna 30, while 59D in the front side is a limit switch for detecting the limit angle of depression of antenna. 60 is photo-interrupter (hereinafter referred to as antenna E sensor) for detecting home position in the elevation and the light shielding filler provided to a rotary shaft 53 advances thereto at the home position.

In this embodiment when the Az sensor 49 and E sensor 60 detects the home position, the main lobe of antenna 30 matches with the front direction of automobile CAR (running direction of automobile when it runs forward in straight: same in hereafter) and becomes parallel with the roof Rf.

Figure 2A:
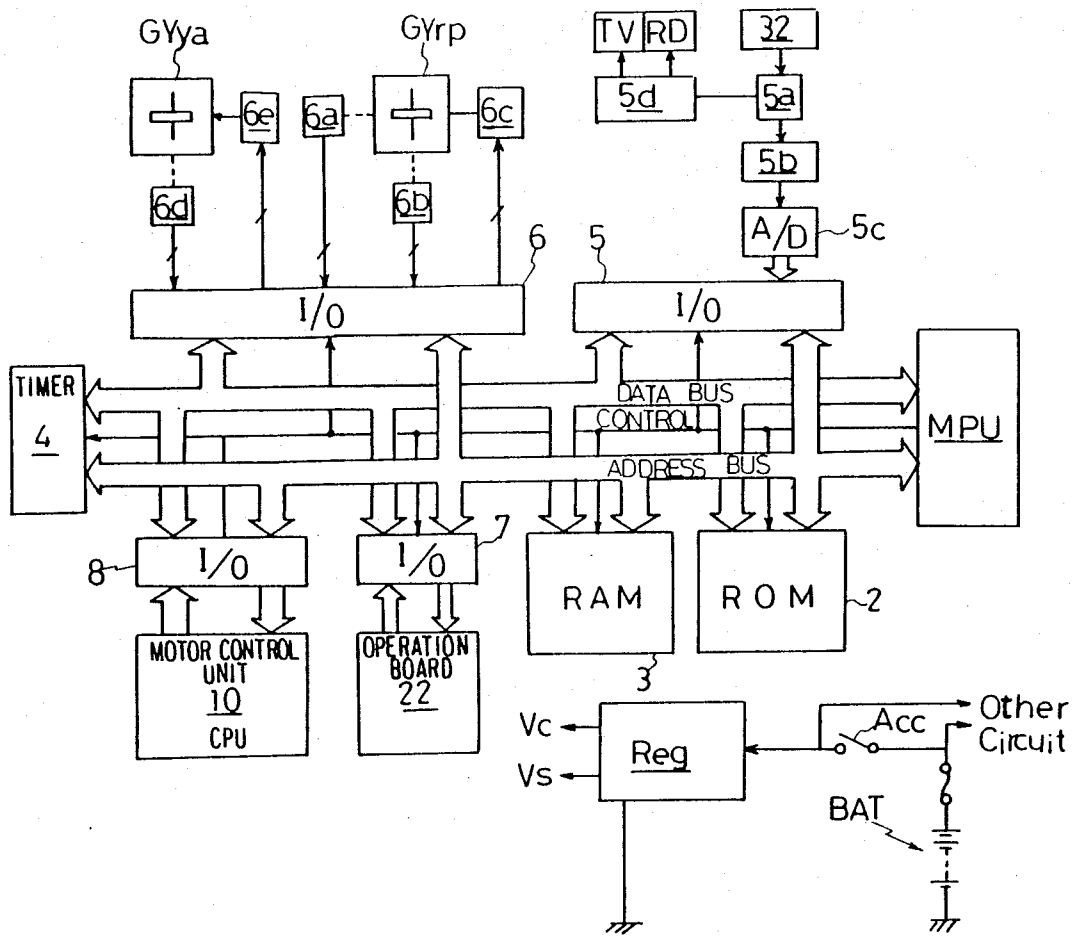
FIG. 2*a* is a block diagram indicating electrical structure of antenna attitude control system as an embodiment of the present invention.

FIG. 2*a* indicates structure of electrical control system for controlling attitude of antenna 30.

This control system is formed mainly by a microcomputer (hereinafter referred to as CPU) 1. The bus like of MPU 1 is connected with a read only memory (ROM) 2, a random access memory (RAM) 3, a timer and input-/output ports (I/O) 5, 6, 7 and 8.

The timer 4 sets the period of step track and generates an interrupt request to MPU 1 for every specified time (determined as 0.25 sec in this embodiment.

I/O 5 is connected with a unit for detecting receiving level of antenna 30. The receiving level detection unit is formed by a BS converter 32 of antenna 30, a distributor 5*a*, an amplifier, a BS level detector 5*b* comprising a frequency converter and detector and A/D converter 5*c*.

The distributor 5*a* distributes an output of BS converter 32 of antenna 30 to the BS level detector 5*b* and BS tuner 5*d*.

The BS level detector 5*b* detects level of receiving signal and applies it to the A/D converter 5*c*.

The A/D converter 5*c* converts the receiving signal level sent from the BS level detector 5*b* responding to instruction from MPU 1 to the digital signal and then transfers it to MPU 1. Moreover, BS tuner 5*d* is connected with a television receiver TV for receiving satellite broadcast programs and a radio receiver RD.

I/O 6 is connected with an automobile attitude detection unit. The automobile attitude detection unit is formed by a pitching rolling angle detection free gyro GYrp, a yawing angle detection gyro GYy angle detector 6*a*, a roll angle detector 6*b*, a yaw angle detector 6*d* and gyro drivers 6*c*, 6*e*. The gyro GYrp has a degree of freedom around the pitch shaft and roll shaft, while the pitch angle detector 6*a* detects a rotation angle data (digital value) around the pitch shaft and the roll angle detector 6*b* detects a rotation angle data (digital value) around the roll shaft. The gyro GYya has a degree of freedom around the yaw shaft and the yaw angle detector 6*d* detects a rotation angle data (digital value) around the yaw shaft. The gyro drivers 6*c* and 6*d* respectively energize the corresponding gyro GYrp or GYya to rotate.

Figure 4:
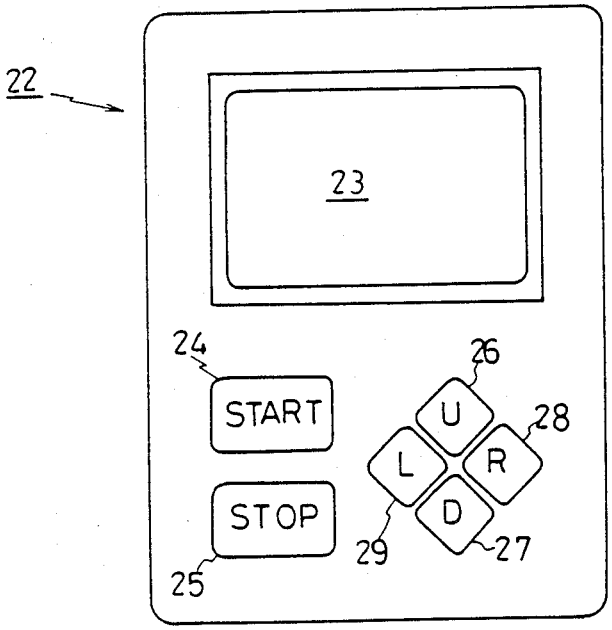
FIG. 4 is a plan view of external appearance of an operation board 22 indicated in FIG. 2*a;*

I/O 7 is connected with an operation board 22, which is provided to the instrument panel within the automobile CAR. The external appearance of operation board is shown in FIG. 4. By referring to FIG. 4, the operation board 22 is provided with a small size CRT display 23 for displaying direction data (hereinafter referred to as azimuth data) and incidence (depression) angle (hereinafter referred to as elevation data), receiving level and various messages of antenna 30, star (START) key 24 for instructing initiation of automatic attitude control of antenna 30, stop (STOP) key 25 for instructing stop of automatic attitude control of antenna 30, up key (U key) 26, down key (D key) 27, right key (R key) 28 and left key (L key) 29 for manual attitude control.

In the operation board, a key encoder for reading key operations responding to instruction from MPU 1 and a CRT driver for displaying various messages to the CRT display 23 are provided.

Figure 2B:
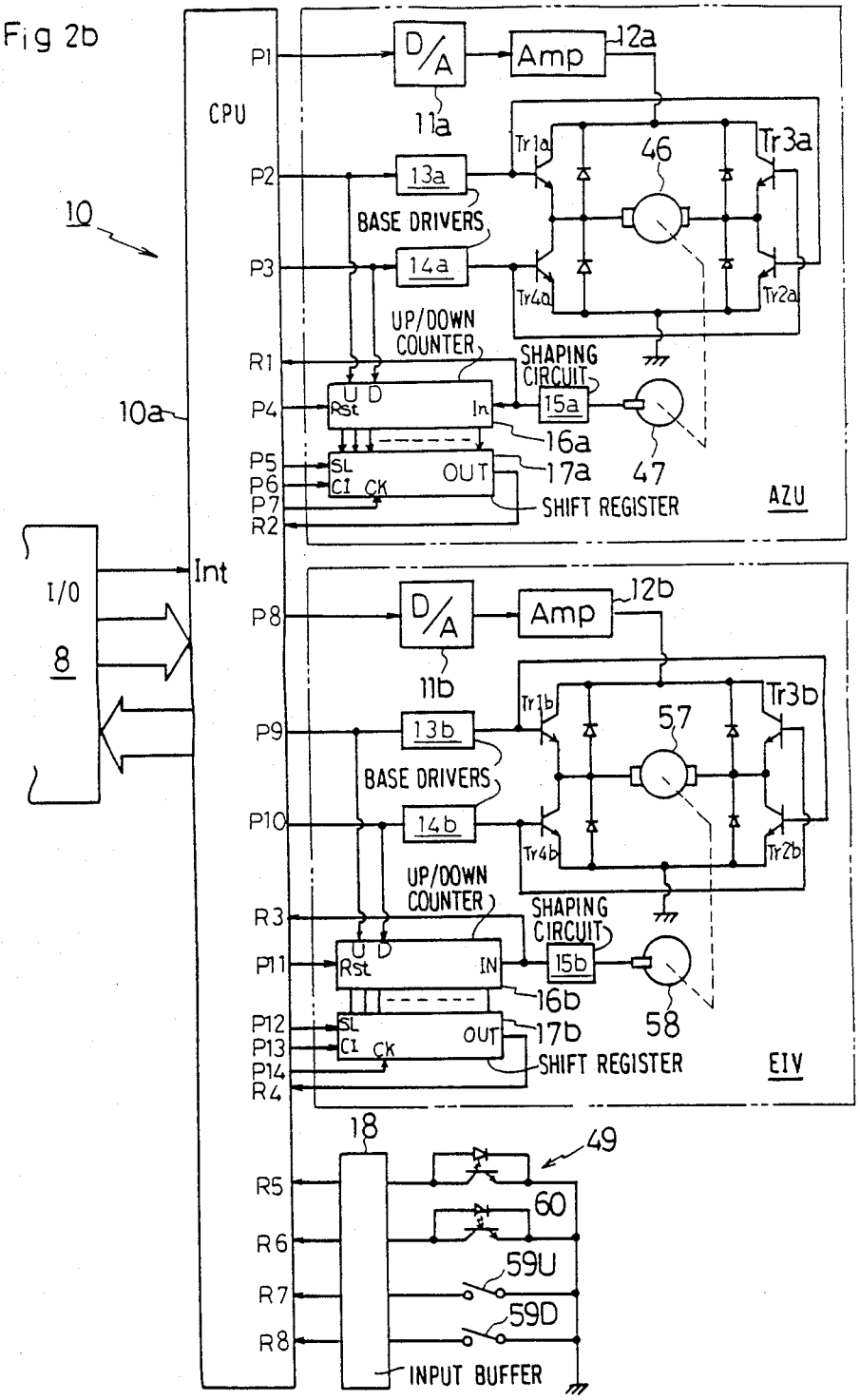
FIG. 2*b* is a block diagram indicating detail of a motor control unit 10 indicated in FIG. 2*a;*

I/O 8 is connected with a motor control unit 10 including an azimuth drive motor 46 and an elevation drive motor 57. Structure of motor control unit 10 is indicated in FIG. 2*b*. By referring to FIG. 2*b*, the motor control unit 10 is formed by a microprocessor hereinafter referred to as CPU) 10*a*, an azimuth unit AzU, elevation unit ElU and input buffer 18, etc.

The azimuth unit AzU is formed by a D/A converter 11*a*, a power amplifier 12*a*, base drivers 13*a*, 14*a*, a waveform shaping circuit 15*a*, an up/down counter 16*a*, a parallel out/serial in shift register (hereinafter referred to as PS register) 17*a*, an azimuth drive motor 46, a rotary encoder 47 and power transistors Tr1*a*, Tr2*a*, Tr3*a* and Tr4*a*.

The elevation unit ElU is formed by a D/A converter 11*b*, a power amplifier 12*b*, base drivers 13*b*14*b*, waveform shaping circuit l5*b*, an up/down counter 16*b*, a PS register 17*b*, an elevation drive motor 57, a rotary encoder 58, power transistors Tr1b, Tr2b, Tr3b and Tr4b.

The input buffer 18 is connected with the Az sensor 49, El sensor 60 and limit switches 59U and 59D explained earlier.

CPU 10*a* controls motors 46 and 57 at the specified speed for attitude control with reversible rotation responding to instructions issued from MPU 1 and transfers the azimuth attitude data (angle), elevation attitude data (angle) and conditions of limit switches 59U and 59*d* to MPU 1.

Since the azimuth unit AzU and elevation unit E U have the similar structure, except for the specifications of structural elements, the azimuth unit AzU is explained here.

A voltage data (digital data) corresponding to energized speed of motor 46 instructed from MPU 1 is applied, from the output port P1 of CPU 10*a*, to the D/A converter 11*a* of azimuth unit AzU. The D/A converter 11*a* outputs a voltage corresponding to such voltage data and applies it to the power amplifier 12*a*.

The power amplifier 12*a* converts an output voltage of D/A converter 11*a* to a drive voltage of motor 46 and applies it to the collectors of power transistors Tr1*a* and Tr3*a*. The emitter of power transistor Tr1*a* is connected to the collector of power transistor Tr4*a*, while the emitter of power transistor Tr3*a* to the collector of power transistor Tr2*a*, and moreover the emitters of power transistors Tr4*a* and Tr2*a* are grounded. The bases of power transistors Tr1*a* and Tr2*a* are connected to the output terminal of base driver 13*a* and the bases of power transistors Tr3*a* and Tr4*a* to the output terminal of base driver 14*a*, respectively. The input terminal of base driver 13*a* is connected to the output port P2 of CPU 10*a*, while the input terminal of base driver l14*a* to the output port P3 of CPU 10*a*, respectively.

CPU 10*a* respectively outputs, to energize the motor 46 for the normal rotation, the H level (high level from the output port P2 and the L level (low level) from the output port P3 and instructs the base driver 13*a* to make on the power transistors Tr1*a* and Tr2*a* and the base driver 14*a* to make off the power transistors Tr3*a* and Tr4*a* respectively. On the other hand, CPU 10*a* respectively outputs, to energize the motor 46 for the reverse rotation, the L level from the output port P2 and the H level from the output port P3 and then instructs the base driver 13*a* to make off the power transistors Tr1*a* and Tr2*a* and the base driver 14*a* to make on the power transistors Tr3*a* and Tr4*a*. Moreover, CPU 10*a* outputs, for deactivation of the motor 6, the L level from the output ports P2 and P3 and instructs the base drivers 13*a* and 14*a* to make off the power transistors Tr1*a*, Tr2*a*, Tr3*a* and Tr4*a*. Since the motor 46 is inserted on the line connecting the connecting point of power transistors Tr1*a* and Tr4*a* and the connecting point of power transistors Tr3*a* and Tr2*a*, when the power transistors Tr1*a* and Tr2*a* turn on and the power transistors Tr3*a* and Tr4*a* turn off, the energizing circuit for normal rotation is formed by the output of power amplifier 12*a*, power transistor Tr1*a*, motor 46, power transistor Tr2*a* and earth and when the power transistors Tr1*a* and Tr2*a* turn off and the power transistors Tr3*a* and Tr4*a* turn on, the energizing circuit for reverse rotation is formed by the output of power amplifier l12*a*, power transistor Tr3*a*, motor 46, power transistor Tr4*a* and earth.

An output of rotary encoder 47 is waveformed shaped by the waveform shaping circuit 15*a* and is then applied to the input port R1 of CPU 10*a* and the input terminal In of up/down counter 16*a*. The up/down counter 16*a* counts up with the rising edge of pulse applied to the input terminal In when the H level is applied to the U terminal while the L level to the D terminal, respectively. Meanwhile, the counter counts down with the rising edge of pulse applied to the input terminal In when the L level is applied to the U terminal while the H level to the D terminal. This up/down counter 16*a* is a 720-step counter (10 bits). When a value is 719, this counter makes the value 0 by the count-up of one and when a value is 0, this counter makes the value 719 by the count-down of one. The reset input terminal Rst of up/down counter 16*a* is connected to the output port P4 of CPU 10*a* and the parallel output terminal of 10 bits is connected to the parallel input terminal of PS register 17*a*.

A shift load pulse is applied to the output port P5 of CPU 10*a* to the shift load input terminal SL of PS register l7*a*, a clock inhibit signal is applied to the clock inhibit input terminal CI from the output port P6 of CPU 10*a*, and a clock pulse is applied to the clock input terminal CK from the output port P7 of CPU 10*a*. The PS register 17*a* presets the data applied to the parallel input terminal at the rising edge of shift load pulse to each bit and outputs serially the data preset in synchronization with the clock pulse to the serial input port R2 of CPU 10*a* from the output terminal OUT when the clock inhibit signal turns to the H level.

By returning to FIG. 2*a*, a power supply of this system is provided as a car battery and constant voltages Vc and Vs are supplied to each part from a regulated voltage circuit Reg through an Acc switch (accessory mode switch). The constant voltage Vc is mainly the power supply for each part of electrical control system and the constant voltage Vs is mainly the power supply for motor and gyro.

Next, the antenna attitude control of the embodied apparatus resulting from the structure explained above and the control operations of MPU 1 and CPU 10*a* is explained hereunder.

Figure 5A:
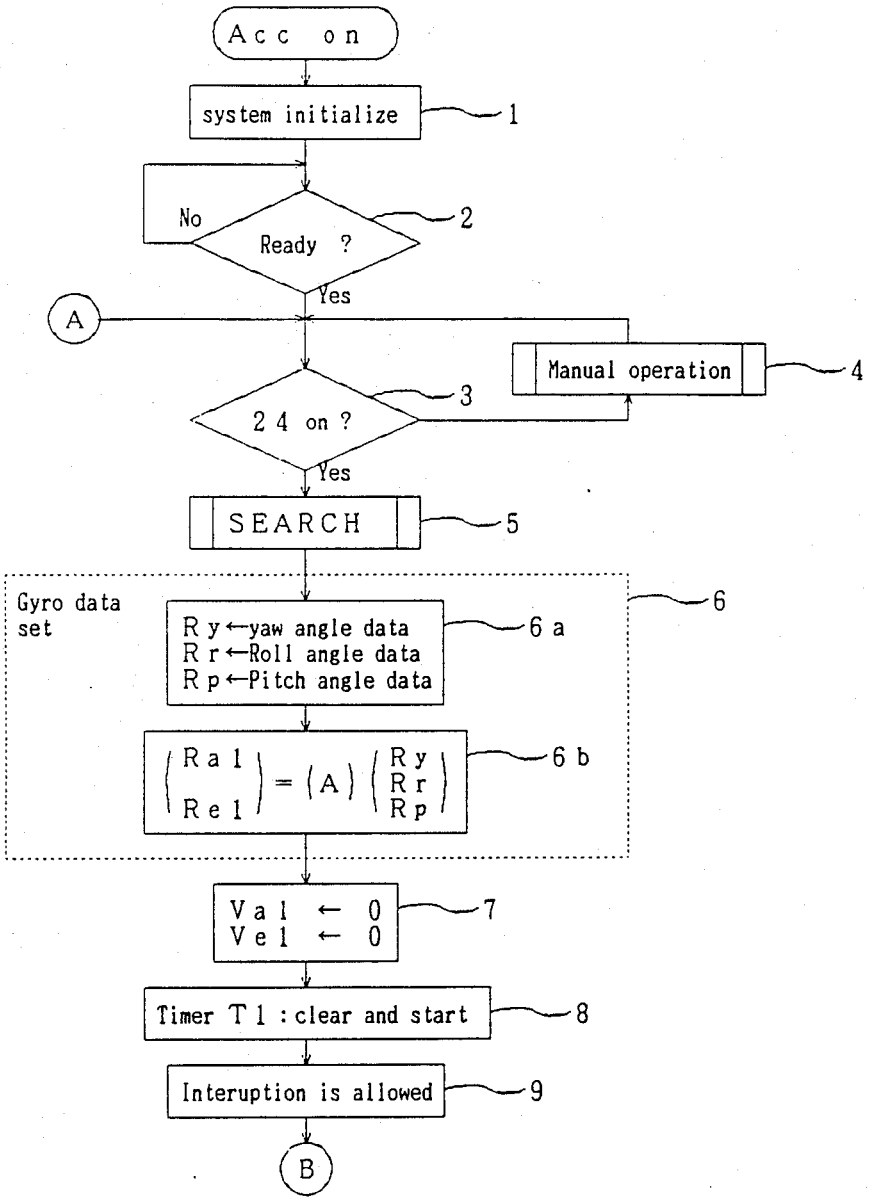
FIG. 5*a*, FIG. 5*b*, FIG. 6, FIG. 7 and FIG. 8 are flowcharts indicating operations of a microcomputer 1 indicated in FIG 2*a;*
Figure 5B:
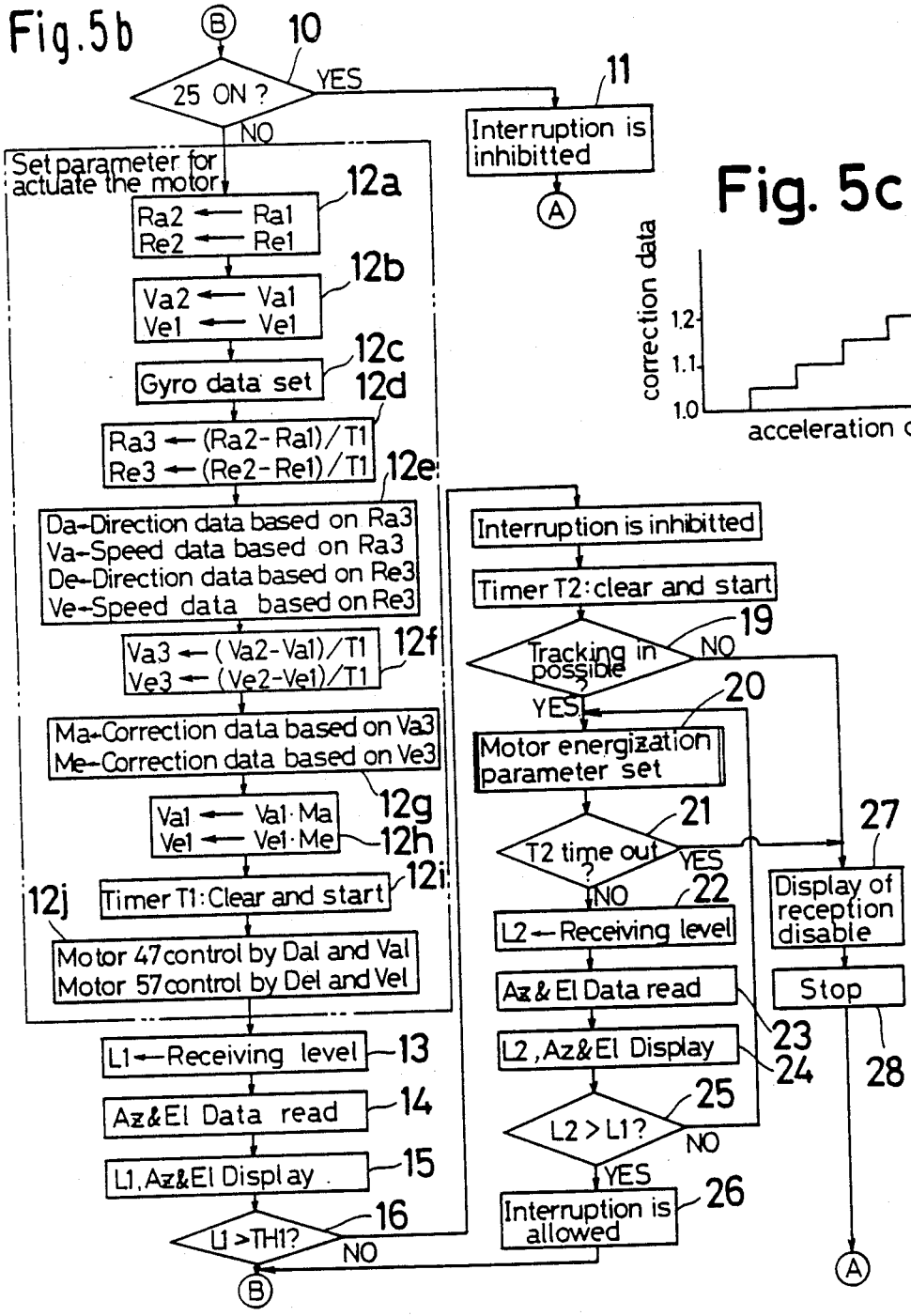
Figure 9:
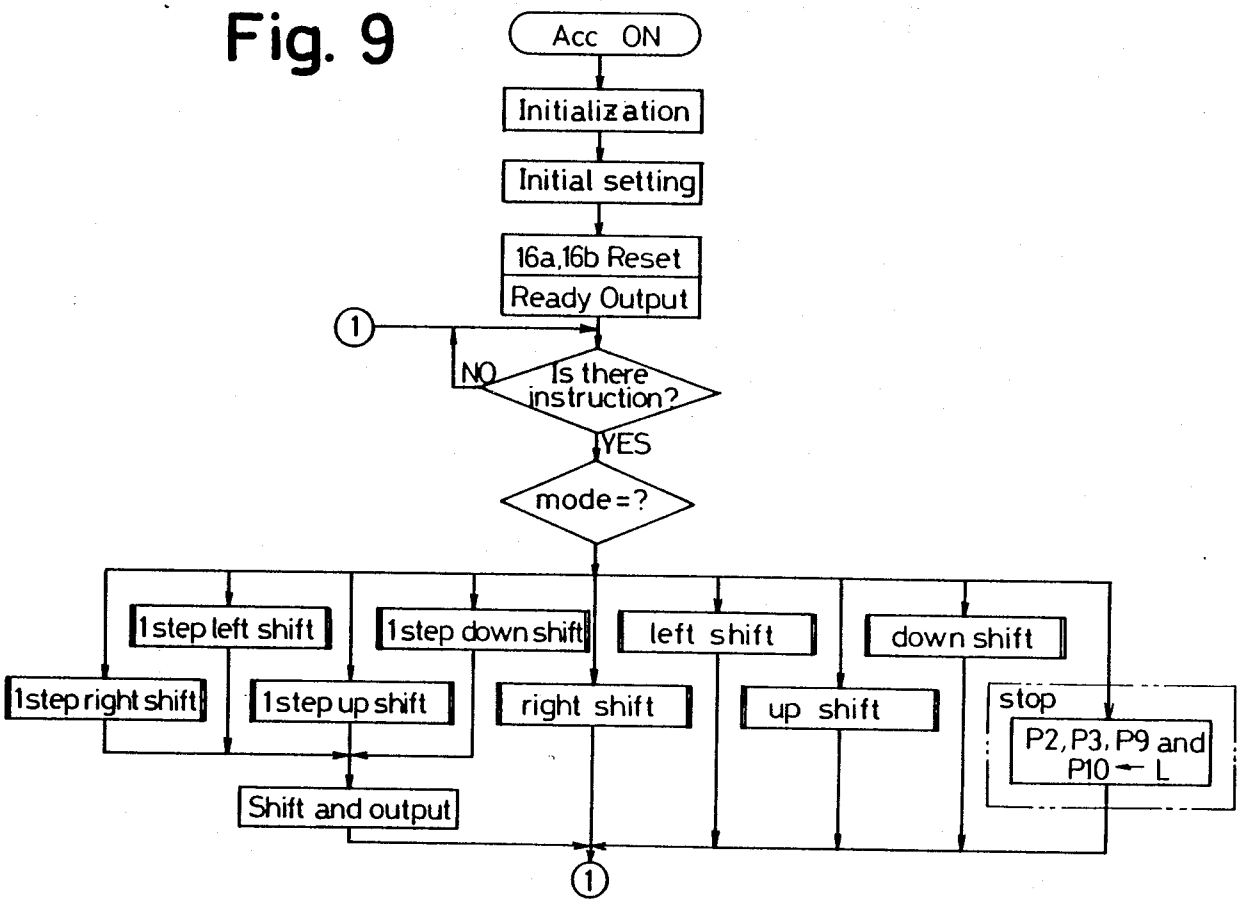
FIG. 9, FIG. 10*a*, FIG. 10*b*, FIG. 10*c*, FIG. 10*d*, FIG. 10*e*, FIG. 10*f*, FIG. 10*g* and FIG. 10*h* are flowcharts indicating operations of a microprocessor 10*a* indicated in FIG. 2*b;*

The flowcharts indicated in FIG. 5*a* nd FIG. 5*b* indicate the main routine of MPU 1 and the flowchart indicated in FIG. 9 indicates the main routine of CPU 10*a*.

By referring to FIG. 5*a*, when the Acc switch is turned on and specified voltage is supplied to each part, MPU 1 resets and initializes each input/output port, internal register, flag and RAM, etc. in the step S1 (indicating the number given to each step of flowchart: same in hereafter) and forms, in the step S2, a loop waiting for the Ready signal from CPU 10*a*.

By referring to FIG. 9, in this case, CPU 10*a* resets and initializes input/output port, internal register in order to execute initial setting. In the initial setting the antenna 30 is set to the home position in the directions of azimuth and elevation. Namely, the motor 46 is energized for normal rotation in order to search the home position in the azimuth direction wherein the Az sensor 49 turns off (light shielding). Thereafter, the motor 57 is energized once for reverse rotation to set the antenna to the attitude with the limit depression angle while monitoring the limit switch 59D. The motor 57 is then energized for normal rotation to search the home position in the elevation direction wherein the E sensor 50 turns off (light shielding). Upon completion of setting of attitude of antenna 30 to the home position in the directions of azimuth and elevation, CPU 10*a* resets the counters 16*a* and 16*b* and outputs the Ready signal to MPU 1. Thereafter, depending on the mode instructed from MPU 1, CPU 10*a* executes the 1-step right shift processing, 1-step left shift processing, 1-step upper shift processing, 1-step lower shift processing, right shift processing, left shift processing, upper shift processing and lower shift processing or stop processing. These processings are explained later.

Upon reception of Ready signal from CPU 10*a*, MPU 1 forms a loop to execute the manual operation processing of the step S4 until the START key 24 is turned on for operation.

Figure 6:
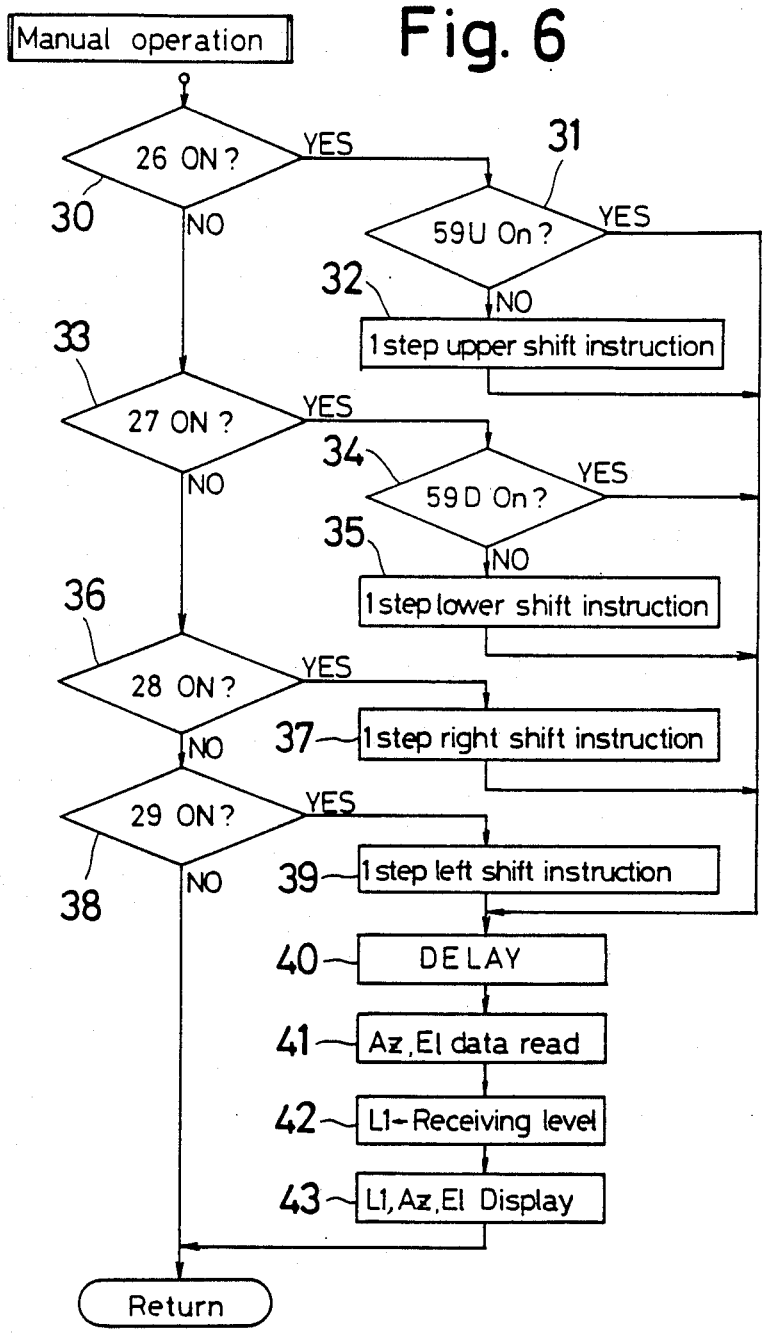

Here, the manual operation processing is explained by referring to the flowchart of FIG. 6. When the U key 26 is operated, operation proceeds to the step S31 from S30 and condition of switch 59U is checked. When the switch 59U is on, attitude of antenna 30 in the direction of elevation is in the limit of incident angle and further drive in the upper direction is no longer possible. In other cases, however, execution of 1-step upper shift processing is instructed to CPU 10*a* in the step S32. Moreover, when the D key 27 is operated, operation proceeds to the step S34 from S33 and condition of switch 59D is checked. When the switch 59U is on, attitude of antenna 30 in the direction of elevation is in the limit of depression angle and further drive in the lower direction is no longer possible. In of 1-step lower shift processing other cases, execution of 1-step lower shift processing is instructed to CPU 10*a* in the step S35. When the R key 28 is operated, operation proceeds to the step S37 from S36 and execution of 1-step right shift processing is instructed to CPU 10*a* in this step. When the L key 29 is operated, operation proceeds to the step S39 from S38, execution of 1-step left shift processing is instructed to CPU 10*a* in this step.

Figure 10A:
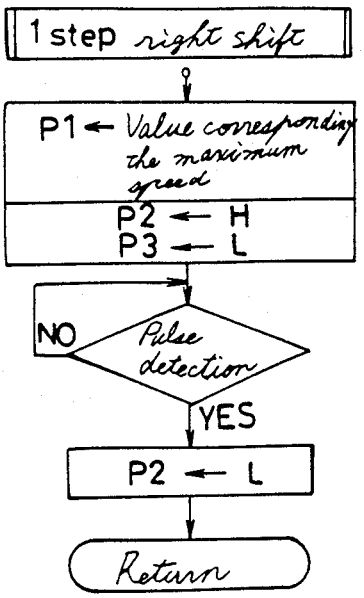
Figure 10B:
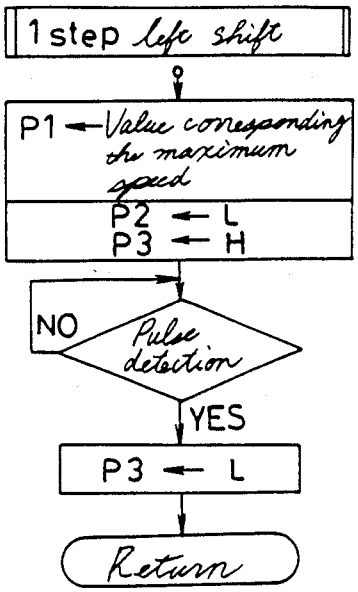
Figure 10C:
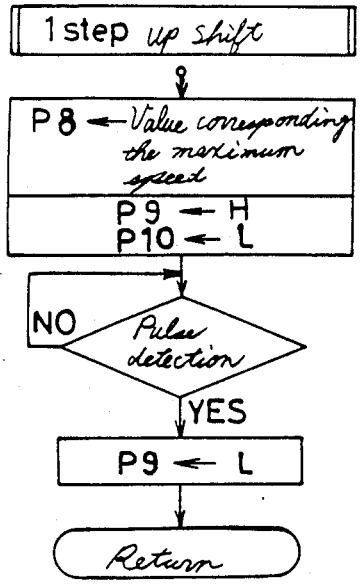
Figure 10D:
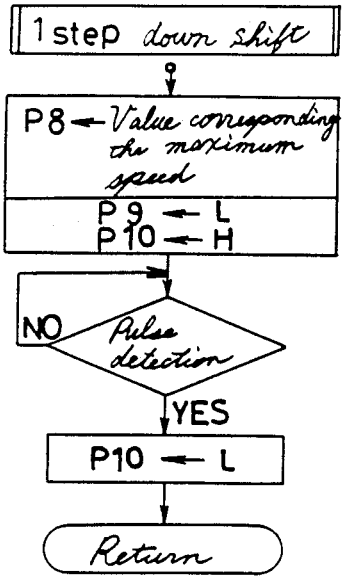

The 1-step right shift processing to be executed by CPU 10*a* responding to such instructions is indicated in FIG. 10*a*, while the 1-step left shift processing in FIG. 10*b*, 1-step upper shift processing in FIG. 10*c* and 1-step lower shift processing in FIG. 10*d*, respectively. Since these processing contents are almost equal, the 1-step right shift processing is explained here by referring to FIG. 10*a*. CPU 10*a* outputs a voltage data corresponding to the maximum speed of motor 46 from the output port P1 and applies it to the D/A converter 11*a*, outputs the H level from the output port P2 and the L level from the output port P3 to the base driver 13*a* to make on the power transistors Tr1*a* and Tr2*a*, instructs the base drive 14*a* to make off the power transistors Tr3*a* and Tr4*a* and then instructs the up/down counter 16*a* to make up-count. Thereafter, when the motor 46 rotates normally and an output pulse of rotary encoder 47 detects at the input port R2 through the waveform shaping circuit 15*a*, CPU 10*a* outputs P2 to instruct the base driver 13*a* to make off the power transistors Tr1*a* and Tr2*a* in order to de-energize the motor 46. Namely, in the 1-step right shift processing, attitude of antenna 30 in the azimuth direction is shifted to the right for one step, namely 0.5°. In the same way, in the 1-step left shift processing, attitude of antenna 30 in the azimuth direction is shifted to the left (1 step) and in the 1-step upper shift processing, attitude of antenna 30 in the elevation direction is shifted in the upper direction for 0.5° (1 step). In the 1-step lower shift processing, attitude of antenna 30 in the elevation direction is shifted to the lower direction for 0.5° (1 step). Upon completion of the 1-step right shift processing, 1-step left shift processing, 1-step upper shift processing or 1-step lower shift processing, CPU 10*a* transfers the signal which indicates the end of shift, attitude data in the azimuth direction (hereinafter referred to as Az data) and attitude data in the elevation direction (hereinafter referred to as El data) to MPU 1.

By returning to FIG. 6, MPU 1 waits for execution of 1-step right shift processing, 1-step left shift processing, 1-step upper shift processing or 1-step lower shift processing by CPU 10*a* in the step S40 and reads Az data and E data transferred in the step S41. Moreover, in the step S42, the receiving level of antenna 30 is read through the receiving level detection unit and is stored in the register L1. In the step S43, the Az data, E data and receiving level of register L1 are displayed on CRT 23.

Figure 7:
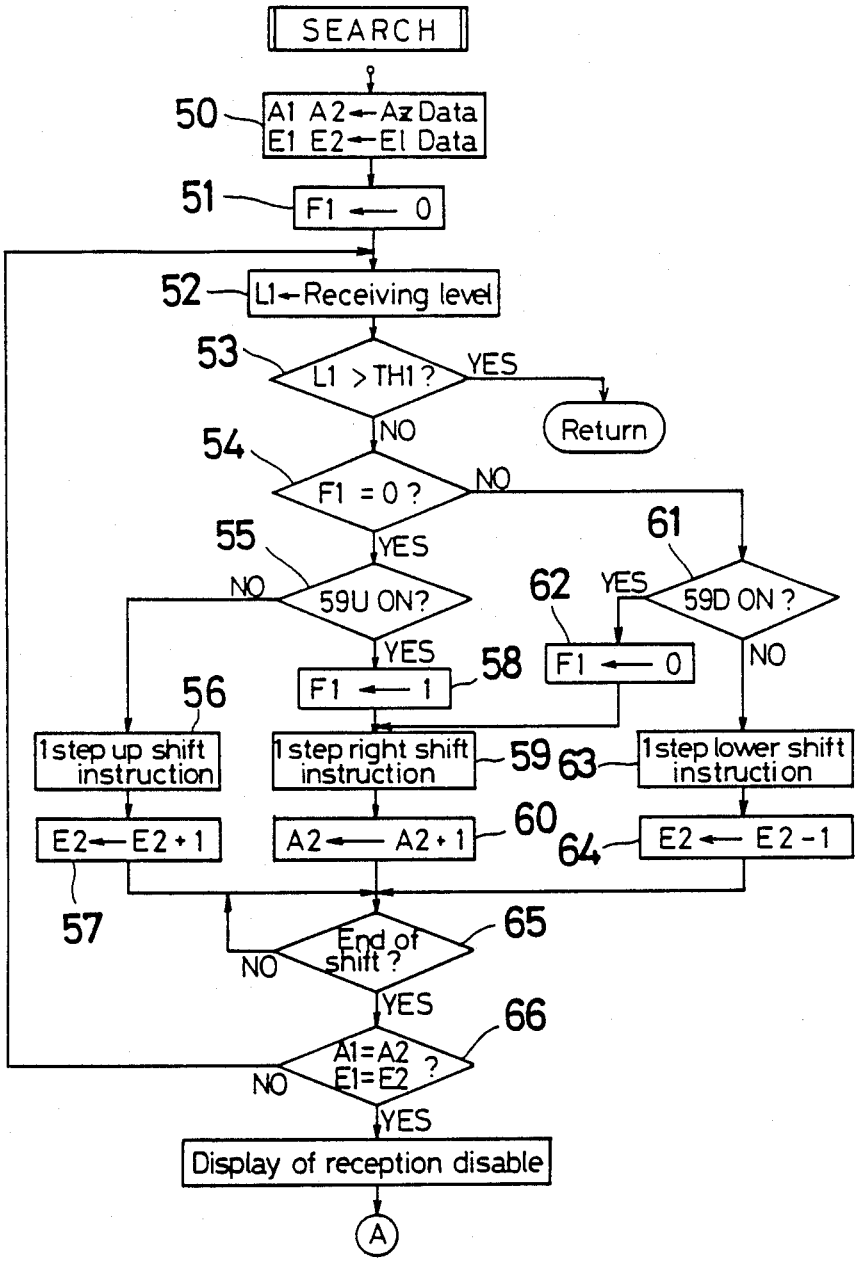

When the START key 24 is operated, operation proceeds to the step S5 from S3 and MPU 1 executes the SEARCH processing in FIG. 7.

Figure 11A:
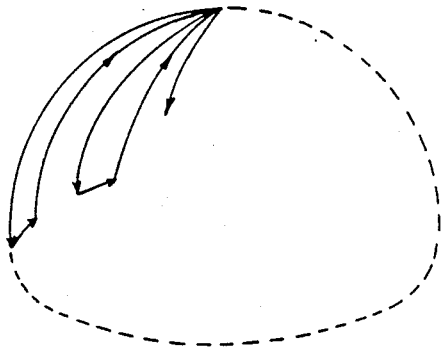
FIG. 11*a* is a schematic diagram for explaining the concept of search processing executed by the microcomputer computer 1 indicated in FIG. 2*a*.

Prior to explanation of SEARCH processing by referring to FIG. 7, the concept of SEARCH processing is explained by referring to FIG. 11*a*. In this processing, attitude of antenna 30 is sequentially shifted in every step in the direction of elevation while monitoring the receiving level of antenna 30. When the antenna 30 reaches the upper limit position (limit of incident angle), the antenna is shifted by one step to the right of azimuth direction. Thereafter, the antenna is sequentially shifted for every step to the lower direction of elevation from the upper limit position. When the antenna reaches the lower limit position (limit of depression angle), it is then shifted by one step to the right of azimuth direction. After repeating such shift operations, the attitude of antenna 30 is searched to obtain the sufficient receiving level. FIG. 11*a* is a model for indicating the locus of main lobe in such shift operation. In actual, movement of 1 step corresponds to the angle of 0.5° and therefore the locus becomes so far more fine.

The SEARCH processing is explained more concretely by referring to FIG. 7.

In the step S50, when the Az data is stored in the registers A1 and A2 while the El data in the registers El and E2, the flag F1 is reset (0) in the step S51. This flag F1 sets the shift direction (upper or lower direction) of the elevation.

Thereafter, the receiving level is read in the step S52 and such value is stored in the register L1. In this case, when the receiving level, namely a value of register L1 exceeds the level TH 1 sufficient for reception (hereinafter referred to as limit level), operation immediately returns to the main routine from the step S53. Otherwise, operation proceeds to the steps after the step S54 to change attitude of antenna 30.

In the case of changing the attitude of antenna, if the flag F1 is reset (0), execution of 1-step upper shift processing is instructed to CPU 10*a* in the step S56 and the register E2 makes increment of 1 in the step S57 to the value thereof. In the step S65, when the signal indicating the end of shift operation is received from CPU 10*a*, operation returns again to the step S52 and above operations are repeated while monitoring the receiving level.

When the attitude of antenna 30 reaches the limit of incident angle before the receiving level exceeds the limit level TH1 and the switch 59U turns on, operation proceeds to the step S58 from S55, setting (1) the flag F1. Thereafter, in the step S59, execution of the 1-step right shift processing is instructed to CPU 10*a* and the register A2 makes increment of 1 in the step S60 to the value thereof (when a value of register A2 becomes 720, it is reset to 0: same in hereafter).

After the flag Fl is set (1), execution of the 1-step lower shift processing is instructed to CPU 10*a* in the step 63 and the register E2 makes decrement of 1 to the value thereof in the step S64. When the attitude of antenna 30 reaches the limit of depression angle and the switch 59D turns on before the receiving level exceeds the limit level TH1 by repeating such processings, operation proceeds to the step S62 from S61 and the flag Fl is reset (0). After execution of the 1-step right shift processing is instructed to CPU 10*a* in the step 59, the register A2 makes increment of 1 in the step S60.

While repeating such processings, when the receiving level exceeds the limit level TH1, operation returns to the main routine. If attitude of antenna 30 corresponds to the condition when the SEARCH processing is started, before the receiving level exceeds the limit level TH1, namely if a value of register A2 becomes equal to a value of register A1 and a value of register E2 becomes equal to a value of register E1, operation proceeds to the step S67 from S66, operation returns to the step S3 of the main routine (FIG. 5*a*) by displaying "reception enable" on the CRT 23.

When the attitude of antenna 30 to obtain the receiving level exceeding the limit level TH1 is searched in the SEARCH processing, the gyro data is set in the step S6. In this processing, the yaw angle data obtained by yaw angle detector 6*d* is stored in the register Ry and the roll angle data obtained by the roll angle detector 6*b* is stored in the register Rr and the pitch angle data obtained by the pitch angle detector 6*a* is stored in the register Rp in the step S6*a*. Thereafter, in the step S6*b* these data are converted to the data of azimuth direction and elevation direction of antenna 30 using the conversion matrix (description of the higher order item is omitted in the step S6*b* of flowchart). This converting calculation is executed by referring to the conversion table stored in ROM 2. The gyro data in the azimuth direction is stored in the register Ra1, while the gyro data in the elevation direction to the register Rel, respectively.

When the gyro data is set in the step S6, the registers Val and Vel are cleared (0) in the step S7 and the timer T1 (internal timer) is cleared and started in the step S8. Thereafter, interruption is allowed in the step S9. When interruption is allowed, the step track processing is executed in the timer interrupt routine of FIG. 8 for every generation of interruption request of timer 4.

Figure 8:
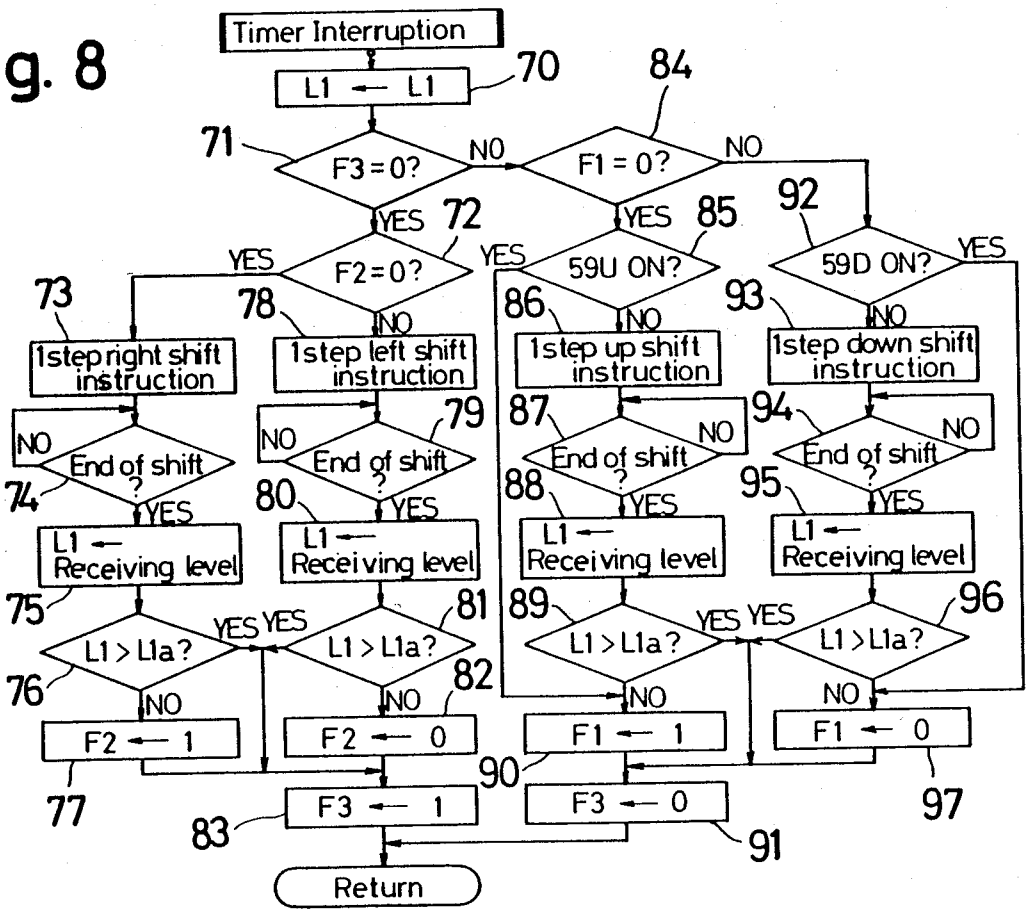
Figure 11B:
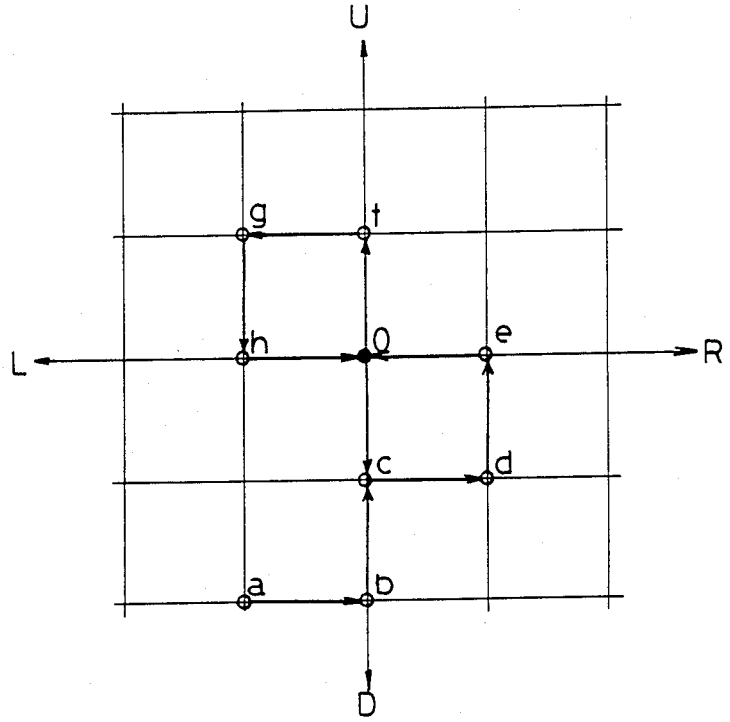
FIG. 11*b* is a schematic diagram for explaining the concept of step track processing executed by the microcomputer 1 indicated in FIG. 2*a*.

Prior to explanation of step track processing by referring to FIG. 8, the concept thereof is explained by referring to FIG. 11*b*.

FIG. 11*b* shows the concept of step track processing developed on the plane. In this figure, a square means the one step (0.5°) in the directions of elevation and azimuth. The alphabets a, b, c, d, e, f, g, h and small circles o indicate projection of the main lobe (center) of antenna 30 and arrow marks indicate shifting direction of attitude of antenna 30. Moreover, it is assumed that the isotropic antenna exists at the points given the circles o. Therefore, the field intensity is equal at the points c, e, f, h and the field intensity is lowered at the points d, g, b, and a in this sequence than that at the above points. The step track processing from the condition where the antenna 30 is directed to the point a will then be explained hereunder.

(1) After the field intensity at the point a (to be considered as equal to the receiving level: same in hereafter) is once stored, the antenna is directed to the point b after one step shift to the right in the azimuth direction. Here, field intensity at the point a is compared with that at the point b. Since the field intensity of point b is higher than that of point a, shift direction in the azimuth direction is not changed (kept to "right").

(2) After the field intensity of point b is stored, the antenna is directed to the point c after one step shift in the elevation direction and the field intensity of the point b is compared with that of the point c. Since the field intensity of the point c is higher than that of the point b, shift direction of the elevation is not changed ("upper" direction is unchanged).

(3) After the field intensity of the point c is stored, the antenna is directed to the point d after one step shift to the right of azimuth direction. The field intensity of the point c is compared with that of the point d. Since the field intensity of the point c is higher than that of the point d, the shift direction of azimuth is changed to the left.

(4) After the field intensity of the point d is stored, the antenna is directed to the point e after one step shift of the elevation and the field intensity of the point d is compared with that of the point e. Since the field intensity of the point e is higher than that of the point d, the shift direction of elevation is not changed ("upper" direction is unchanged).

(5) Since the shift direction of azimuth is changed to the left, the field intensity of the point e is stored. Thereafter, the antenna is directed to the point o after one step shift to the left of the azimuth. Here, the field intensity of the point e is compared with that of the point o. Since the field intensity of the point o is higher than that of the point e, the shift direction of azimuth is not changed ("left" direction is unchanged).

(6) After the field intensity of the point o is stored, the antenna is directed to the point f after on step shift of elevation. Here, the field intensity of the point o is compared with that of the point f. Since the field intensity of the point o is higher than that of the point f, the shift direction of elevation is changed the lower side.

(7) After the field intensity of the point f is stored, the antenna is directed to the point g after one step shift to the left of azimuth direction. The field intensity of the point f is compared with that of point g. Since the field intensity of the point f is higher than that of the point g, shift direction of azimuth is changed to the right.

(8) Since the shift direction of elevation is changed to the lower direction, the field intensity of the point g is stored. Thereafter, antenna is directed to the point h after one step shift in the lower direction of elevation and the field intensity of the point g is compared with that of the point h. Since the field intensity of the point h is higher than that of the point g, shift direction of elevation is not changed ("lower" direction is unchanged).

(9) Since shift direction of azimuth is changed to the right, the field intensity of the point h is stored. Thereafter, the antenna is directed to the point o after one step shift to the right of azimuth and the field intensity of the point h is compared with that of the point o. Since the field intensity of the point o is higher than that of the point h, shift direction of azimuth is not changed ("right" direction is unchanged).

(10) After the field intensity of the point o is stored, the antenna is directed to the point c after one step shift to the lower direction of elevation. The field intensity of the point o is compared with that of the point c. Here, since the field intensity of the point o is higher than that of the point c, shift direction of elevation is changed to the upper direction.

(11) As the successive processings, the processings explained above are repeated after returning to the step (3).

Namely, in the step trap processing, the attitude control of antenna 30 is carried out so that the signal source exists at the center of locus of main lobe of the antenna 30. Therefore, in case the signal source moves relatively to the antenna 30, attitude control is carried out in such a manner that the locus moves with the signal source and the tracking for the signal source is conducted by the antenna 30.

The step track processing is explained more concretely by referring to FIG. 8.

In the step S70, the receiving level stored in the register L1 is saved to the register L1*a*.

The flag F3 is used for selecting any of the azimuth shift or elevation shift. When this flag is reset (0), operation proceeds to the step S72 from S71 to check the flag F2.

The flag F2 is used for setting the direction of azimuth shift (right or left). When this flag is reset (0), execution of the 1-step right shift processing is instructed to CPU 10*a* in the step S73.

Upon reception of the signal indicating the end of shift from CPU 10*a*, the receiving level of antenna 10 after renewing attitude of antenna is read in the step S75 and such value is stored in the register L1.

In the step S76, the receiving level 1 and the receiving level before right shift of one step, namely a value of register L1 and a value of register L1*a* are compared with each other. When a value of register L1 is larger, it means the antenna is coming near to the direction of signal source. Therefore, in the step S83, the flag F3 is set (1) and operation returns to the main routine. In other case, it means that the antenna becomes far from the direction of signal source. Therefore, the flag F2 is set (1) in the step S77 and the flag F3 is then set (1) in the step S83. Thereby the operation returns to the main routine.

When the next timer interrupt is generated, since the flag F3 is set (1), operation proceeds to the step 84 from S71 to check the flag F1. As explained earlier the flag F1 is used for setting the direction (upper or lower) of shift of elevation. When the flag F1 is reset(0), condition of switch 59U is checked in the step S85. If it is not on, execution of the 1-step upper shift processing is instructed to CPU 10*a* in the step S86.

Upon reception of the signal indicating the end of shift from CPU 10*a*, the receiving level of antenna 30 after changing attitude in the step S88 is read and it is then stored in the register L1.

In the step S89, the receiving level 1 and the receiving level before the one step upper shift, namely a value of register L1 and a value of register L1*a* are compared and when the value of register L1 is larger, it means that the antenna is coming near to the signal source. In this case, the flag F3 is reset (0) in the step S91 and operation returns to the main routine. Otherwise, it means that the antenna becomes far from the signal source. In this case, the flat F1 is set (1) in the step S90, the flat F3 is reset (0) in the step S91, and the operation returns to the main routine.

Processing while the flag F2 is set (1), namely the processing for comparing the receiving levels before and after the one step left shift, and the processing conducted when the flag F1 is set (1), namely the processing for comparing the receiving levels before and after the one step lower shift are not explained here because it results in repeated explanation of the above processings.

Here, reference is made to FIG.

In the motor energization parameter set processing in the step S12, the gyro data of azimuth direction stored in the register Ra1 is saved to the register Ra2 in the step S12a, the gyro data of elevation direction stored in the register Re1 is saved to the register Re2, the speed data of azimuth direction stored in the register Va1 is saved to the register Va2 in the step S12*b*, and the speed data of elevation direction stored in the register Vel is saved to the register Ve2.

Thereafter, the gyro data set processing equal to the processing in the step S6 explained above is carried out in the step S12c, and the gyro data of azimuth and elevation directions is obtained from the yaw angle data (Ry), roll angle data (Rr) and pitch angle data (Rp) detected by such processing and the data obtained are stored respectively to the registers Ra1 and Rel.

In the step S12d, the data obtained by dividing difference between the data stored in the register Ra2 and the data stored in the register Ra1 with a value of timer T1, namely variation rate data of gyro data of azimuth direction per unit period is stored in the register Ra3, and the data obtained by dividing difference between the data stored in the register Re2 and the data stored in the register Rel with a value of timer T1, namely variation rate data of gyro data of elevation direction per unit period is stored in the register Re3.

In the step S12*e*, a direction data which indicates the energizing direction of motor 47 is set from the sign of variation rate data stored in the register Ra3 and it is then stored in the register Da. Moreover, a speed data (speed data of azimuth direction) corresponding to the energizing speed of motor 47 is set from amplitude of the variation rate data and it is then stored in the register Va. In addition, a direction data which indicates the energizing direction of motor 57 is set from the sign of variation rate data stored in the register Re3 is set and it is then stored in the register De. Next, a speed data (speed data of elevation direction) corresponding to the energizing direction of motor 57 is set from the amplitude of the variation rate data and it is then stored in the register Ve.

The amplitude of variation rate data and the speed data are in the relation of one to one basis and it can be calculated based on the simple rules of calculation. In the case of this embodiment, calculation is conducted by making reference to the table of ROM 2.

In the next step S12f, a variation rate data per unit period of speed data of azimuth direction obtained by dividing difference of the data stored in the register Va2 and the data stored in the register Val with a value of timer T1, namely the acceleration data is stored in the register Va3 and a variation rate data per unit period of speed data of elevation direction obtained by dividing difference between the data stored in the register Ve2 and the data stored in the register Vel with a value of timer T1, namely the acceleration data is stored in the register Ve3.

Figure 5C:
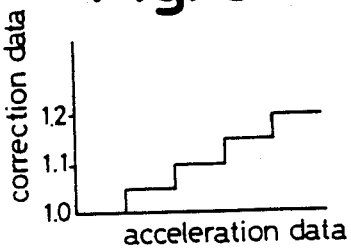
FIG. 5*c* is a graph indicating an calculation for obtaining corrected data being stored in ROM 2 indicated in FIG. 2*a;*

ROM 2 stores the table which indicates relation between the acceleration data and correction data as shown in FIG. 5*c*. In the step S12*g*, the correction data of azimuth direction is obtained by making reference to the table with an absolute value of acceleration data of azimuth direction stored in the register Va3 and the correction data of elevation direction is obtained by making reference to the ROM table with an absolute value of acceleration data of elevation direction stored in the register Ve3. These data thus obtained are respectively stored in the corresponding registers Ma or Me.

In the step S12*h*, the speed data of azimuth direction stored in the register Val is corrected by multiplying a correction data of azimuth direction stored in the register Ma and the speed data of elevation direction stored in the register Vel is corrected by multiplying a correction data of elevation direction stored in the register Me.

As will be understood from FIG. 5*c*, when the acceleration data is smaller than the specified value, the correction data becomes 1 and therefore correction o speed data is not substantially carried out.

In the step S12*i*, the timer T1 is cleared and started. In the step S12*j*, the direction data of azimuth and speed data stored in the registers Da1 and Va1 and the direction data of elevation and speed data stored in the registers Del and Vel are transferred to CPU 10*a* of motor control unit 10 for instructing control for the corresponding motors 47 and 57.

Figure 10E:
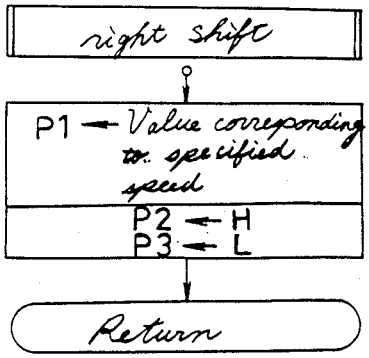
Figure 10F:
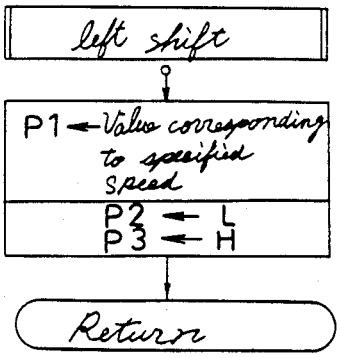

When the direction data of azimuth indicates the right shift, CPU 10*a* executes the right shift processing shown in FIG. 10*e* FIG. 10*e* to output a voltage data corresponding to the instructed speed (speed data) from the output port P1, an H level from the output port P2 to instruct the base driver 13*a* to make on the power transistors Tr1*a* and Tr2*a*, and an L level from the output port P3 to make off the power transistors Tr3*a* and Tr4*a*. When the direction data of azimuth indicates the left shift, CPU 10*a* executes the left shift indicated in FIG. 10*f* to output a voltage data corresponding to the instructed speed from the output port Pl, an L level from the output port P2 to instruct the base driver 13*a* to make off the power transistors Tr1*a* and Tr2*a* and an H level from the output port P3 to instruct the base driver 14*a* to make on the power transistors Tr3*a* and Tr4*a*.

Figure 10G:
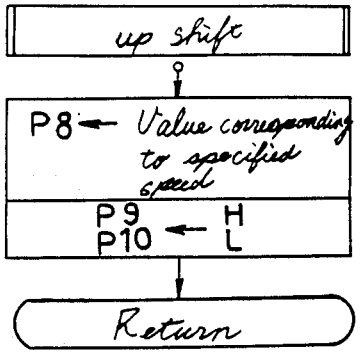
Figure 10H:
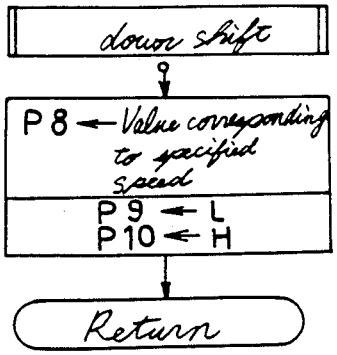

When the direction data of elevation indicates the upper shift, CPU 10*a* executes the upper shift processing indicated in FIG. 10*g* to output a voltage data corresponding to the instructed speed from the output port P8, an H level from the output port P9 to instruct the base driver 13*b* to make on the power transistors Tr1b and Tr2b and an L level from the output port Pl0 to instruct the base driver 14*b* to make off the power transistors Tr3b and Tr4b. When the direction data indicates the lower shift, CPU 10*a* executes the lower shift processing indicated in FIG. 10*h* and outputs a voltage data corresponding to the specified speed from the output port P8, an L level from the output port P8 to instruct the base driver 13*b* to make off the power transistors Tr1b and Tr2b and an H level from the output port P10 to instruct the base driver 14*b* to make on the power transistors Tr3b and Tr4b.

Returning to FIG. 5*b*, in the step S13, a receiving level of antenna 30 is read through the receiving level detection unit and it is then stored to the register L1. In the step S14, the Az data and E data which indicate attitude of antenna 30 are read. These receiving level, Az data and E data are displayed on the CRT 23 in the step S15.

In the step S16, the receiving level of antenna 30 stored in the register L1 is compared with the limit level TH1. When a value of register L1 exceeds the limit level TH1, the step track processing (FIG. 8) explained earlier and attitude control processing for antenna 30 based on the gyro data are executed by repeating the loop, S10 - S12 - S13 - S14 - S15 - S16 - S10 S10 - . . . However, when the STOP key 25 is turned on in the course of this loop, operation proceeds to the step S11 from S10 and returns to S3 of the flowchart indicated in FIG. 5*a* after inhibiting interruption of timer 4.

Here, in the loop for executing the attitude control processing for antenna 30 in the steps S10 to S16, when the receiving level of antenna 30, namely a value of register L1 becomes lower than the limit level TH1 operation separates from this loop and proceeds to the steps after step S17.

In the step S17, interruption of timer 4 is inhibited and in the step S18, the timer T2 (internal timer) is cleared and started. In the step S19, adequacy of tracking is decided. The apparatus of this embodiment is capable of changing attitude of antenna 30 in the maximum speed of +40°/sec for azimuth direction and +20°/sec for elevation direction (the sign indicates the direction), but if relative positional relation between the antenna 30 and signal source changes at a higher speed due to attitude change of automobile CAR, the antenna 30 is no longer tracking the signal source. Namely, in the step S19, applicability of speed data obtained in the step S12 is decided considering above conditions when the receiving level of antenna 30 is lowered.

In case the tracking is possible, drop of receiving level is decided to be resulting from shielding of antenna 30 (for example, by tunnel or building, etc.) and the motor energization parameter set processing similar to that in the step S12 is carried out in the step S20. Thereafter, the receiving level is read in the step S22 and it is then stored to the register L2. In the step S23, the Az data and El data are read and these data are displayed on the CRT 23 in the step S24.

In the step S25, the receiving level read in the step S22, namely a value of register L2 is compared with the receiving level read in the step S13, namely a value of register L1. When the value of register L2 is lower than the value of register L1, operations formed by the loop S20 - S21 - S22 - S23 - S24 - S25 - S20 - . . . is executed in repetition.

Since the interruption is not inhibited in this loop, only the attitude control processing of antenna 30 based on the gyro data is executed without executing the step track processing (FIG. 8) explained previously.

While this loop is executed repeatedly, the receiving environment is changed to good condition (for example, no longer shielded by tunnel or building, etc.) and when the receiving level read in the step S22, namely a value of register L2 exceeds the receiving level read in the step S12, namely a value of register L1, operation returns to the step S10 after allowing again the interruption in the step S26, forming the loop for executing the step track processing (FIG. 8) and attitude control processing for antenna 30 based on the gyro data.

However, when the timer T2 is timed while the receiving environment is not changed to good condition and the receiving level is kept low, operation proceeds to the step S27 from S21, displaying the reception disable condition on the CRT 23. After stop mode is instructed to CPU 10*a* of motor control unit 10 in the step S28, operation returns to the step S3 of flowchart indicated in FIG. 5*a*.

When stop of processing is instructed, CPU 10*a* outputs, as indicated in FIG. 9, the L levels from the output ports P2, P3, P9 and P10 to instruct the base drivers 13*a*, 14*a*, 13*b* and 14*b* to make off the power transistors. Thereby, the motors 46 and 57 are deenergized.

In above embodiment, the step track system is employed for attitude control of antenna when the signal is received through the antenna, but modifications such as the conical scanning system where the attitude control is carried out using the amplitude modulated element of received signal by scanning the main lobe of antenna in such a way as writing a circle or the other examples applied to other moving objects other than the automobile, such as a ship or aircraft, etc. are naturally possible, but these are not explained in detail.

In the embodiment explained above, a correcting data of azimuth and elevation directions is obtained from a variation rate per unit period of the speed data, namely from the acceleration data. However, since it is assumed that the variation rate per unit period of gyro data corresponds to speed data on one to one basis, the acceleration data is considered to be similar to "variation rate per unit period" of corresponding gyro data.

As explained previously, according to the present invention, the antenna is driven under the control by the drive information obtained by correcting, through the weighting by change of time, the first drive information for driving the antenna to the attitude for obtaining high receiving level and the second drive information for correcting relative change of attitude of antenna resulting from attitude change of automobile. Therefore, the antenna is capable of accurately tracking the signal source for quick movement of automobile.

Thereby, the trackability similar to that of attitude control of antenna can be obtained based on the forecasting for behavior of automobile but since the tracking is based on the feedback control as indicated in the embodiment, structure and control can be so far simplified.

What is claimed is:

1. A mobile station antenna attitude control apparatus comprising:

an antenna attitude changeably supported on a mobile station;

a drive mechanism for changing attitude of an antenna at a plurality of different speeds;

a receiving level detecting means for detecting receiving level of an antenna;

a first drive information setting means for renewing and setting first drive information for changing attitude of antenna in a direction resulting in an increase of receiving level by monitoring the receiving level detected by the receiving level detecting means;

an attitude detecting means for detecting attitude information of a mobile station;

a second drive information setting means for renewing and setting second drive information to correct relative change of attitude of an antenna due to attitude change of mobile station based on the attitude information of mobile station detected by said attitude detecting means;

a drive information correcting means for correcting said second drive information depending on change on time of the second drive information set by the second drive information setting means by monitoring such change thereof; and a control means for controlling said drive mechanism based on the first drive information set by said first drive information setting means and the second drive information corrected by said drive information correcting means;

wherein said drive information correcting means corrects said second drive information to that providing a higher speed drive when change of time of the second drive information set by said second drive information setting means is larger than the specified value.

2. A mobile station antenna attitude control apparatus according to claim 1, wherein said first drive information setting means compares at least two receiving levels detected by said receiving level detecting means interposing the control of said drive means to be conducted by said control means based on the first drive information and newly sets the first drive information for changing attitude of antenna to the attitude detecting higher receiving level from that detecting lower receiving level.

3. A mobile station antenna attitude control apparatus according to claim 1, said attitude detecting means comprises a gyro which is not influenced by the attitude of a mobile station.

4. A mobile station antenna attitude control apparatus according to any of claim 1 to 3, wherein a mobile station comprises a radio station provided on an automobile.

* * * * *